US006260557B1

(12) United States Patent
Yarbrough

(10) Patent No.: US 6,260,557 B1
(45) Date of Patent: Jul. 17, 2001

(54) HAIR COLORANT APPLICATOR COMB AND METHOD

(76) Inventor: Christine Yarbrough, 2209 E. Crooked Lk. Dr., Eustis, FL (US) 32726

( * ) Notice: Subject to any disclaimer, the term of this patent is extended or adjusted under 35 U.S.C. 154(b) by 0 days.

(21) Appl. No.: 09/609,481

(22) Filed: Jul. 5, 2000

Related U.S. Application Data

(60) Provisional application No. 60/143,855, filed on Jul. 15, 1999.

(51) Int. Cl.[7] ..... A45D 24/22

(52) U.S. Cl. ..... 132/208; 132/114

(58) Field of Search ..... 132/112, 113, 132/114, 115, 116, 208; 222/478, 632, 633; 401/183, 186, 188 R

(56) References Cited

U.S. PATENT DOCUMENTS

| | | | | |
|---|---|---|---|---|
| 812,241 | * | 2/1906 | Shubert | 132/113 |
| 1,667,631 | * | 4/1928 | Mach | 132/113 |
| 2,139,904 | * | 12/1938 | Merrill | 132/114 |
| 2,381,048 | * | 8/1945 | Habostad | 132/113 |
| 3,295,537 | * | 1/1967 | Young | 132/113 |
| 3,477,447 | * | 11/1969 | Eldredge | 132/113 |
| 5,555,899 | * | 9/1996 | Foreman | 132/114 |

FOREIGN PATENT DOCUMENTS

| | | | | |
|---|---|---|---|---|
| 857852 | * | 12/1952 | (DE) | 132/114 |
| 461339 | * | 12/1913 | (FR) | 132/113 |
| 438005 | * | 11/1935 | (GB) | 132/113 |

* cited by examiner

*Primary Examiner*—Todd E. Manahan
*Assistant Examiner*—David Comstock
(74) *Attorney, Agent, or Firm*—John V. Stewart

(57) ABSTRACT

A hair colorant applicator in the form of a hollow comb 1 with a threaded receiver top 2 that accepts standard plastic bottles 8 of hair colorant in the inverted position. The teeth of the comb are in the form of tubes. A hollow channel 5 in each tube 3 of the comb terminates in an orifice 4*a* at the tip of each tube. Hair colorant 9 flows from the bottle, through the body of the comb 6, through the channels in the tubes, and exits the tips of the tubes. This applies the colorant at the base of hair near the scalp to maintain uniform hair coloring as the hair grows. Newly emerged uncolored hair near the scalp can be colored without deepening the color of the rest of the hair. The user squeezes the bottle of colorant as it is applied to control the flow rate.

2 Claims, 3 Drawing Sheets

FIG 1
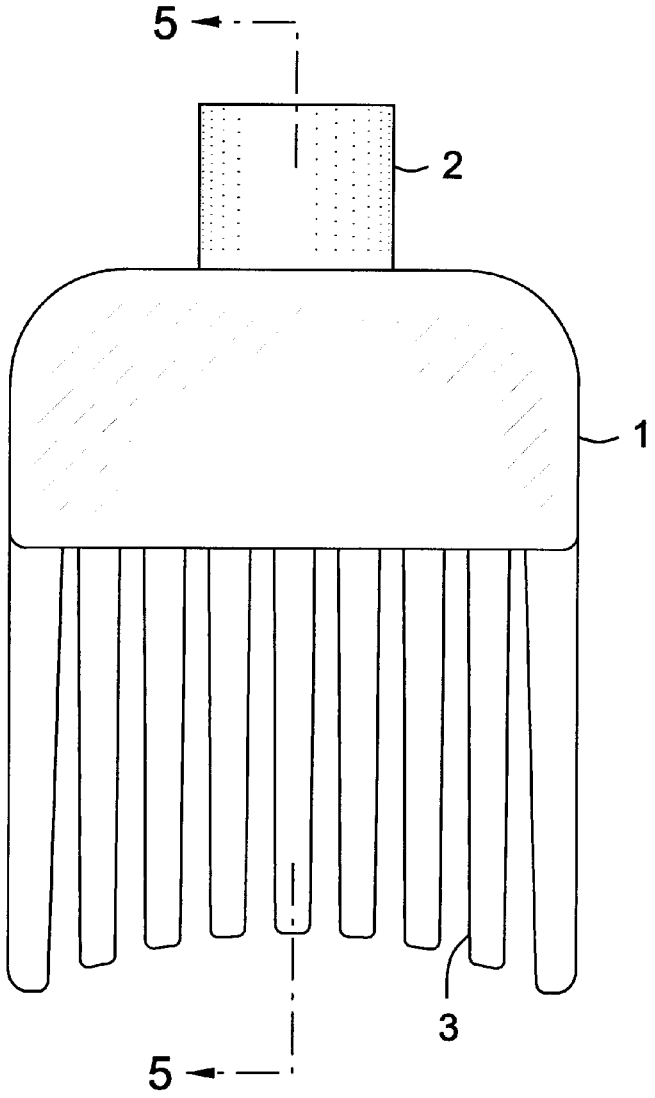
FIG 2
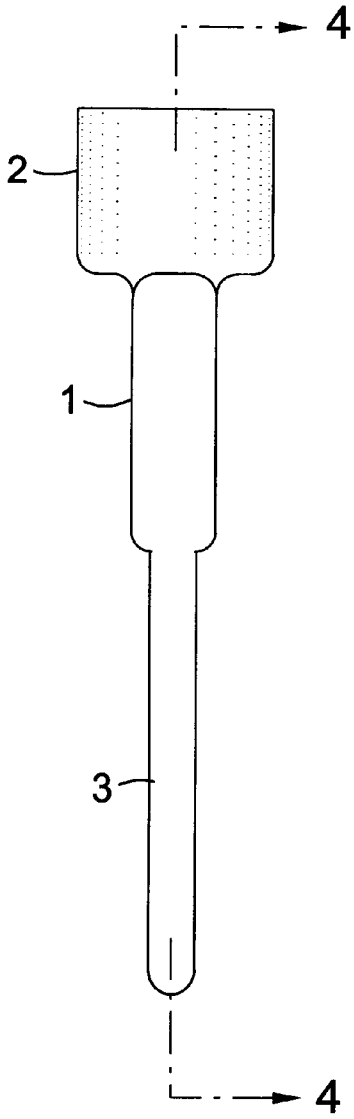
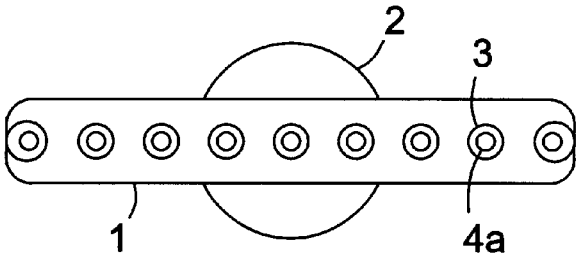
FIG 3

FIG 4
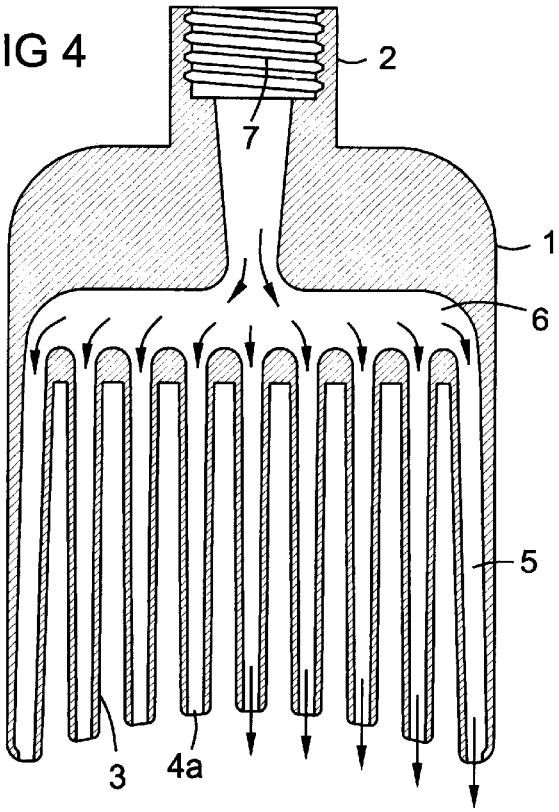
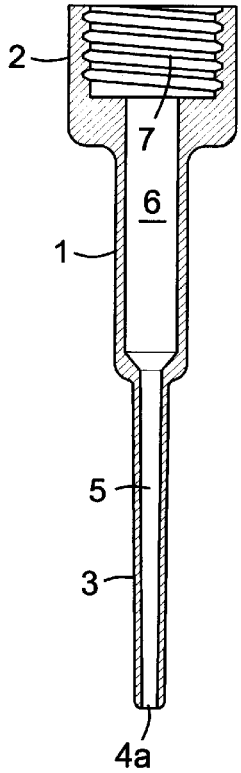
FIG 5
FIG 6
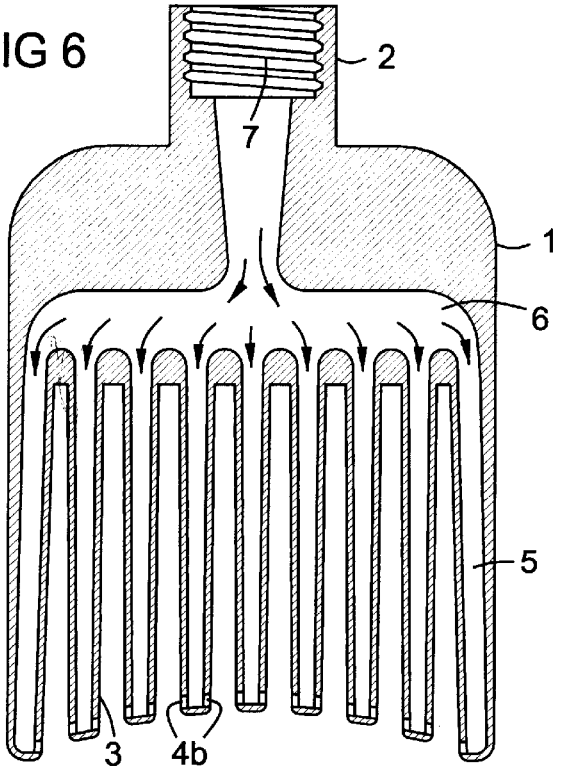
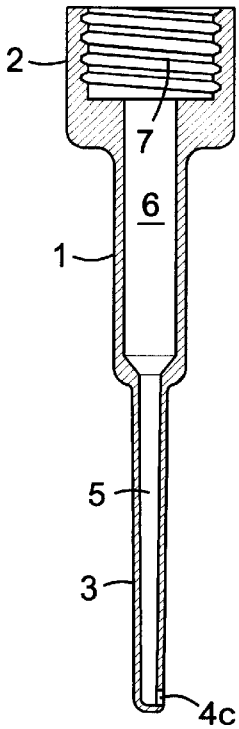
FIG 7

FIG 8
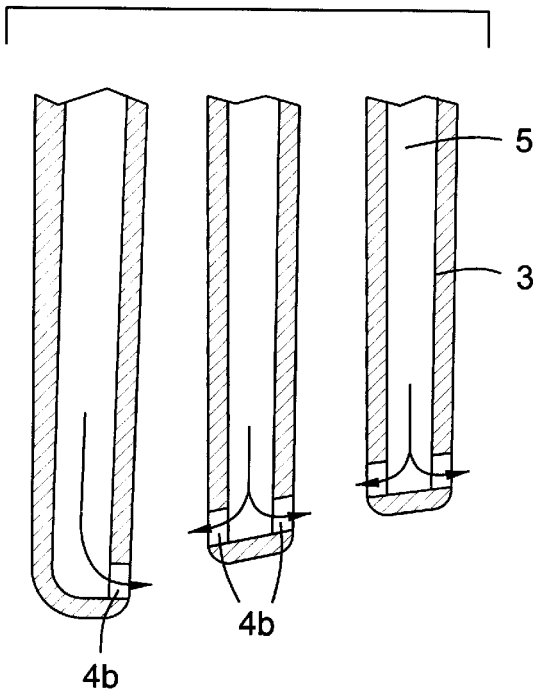
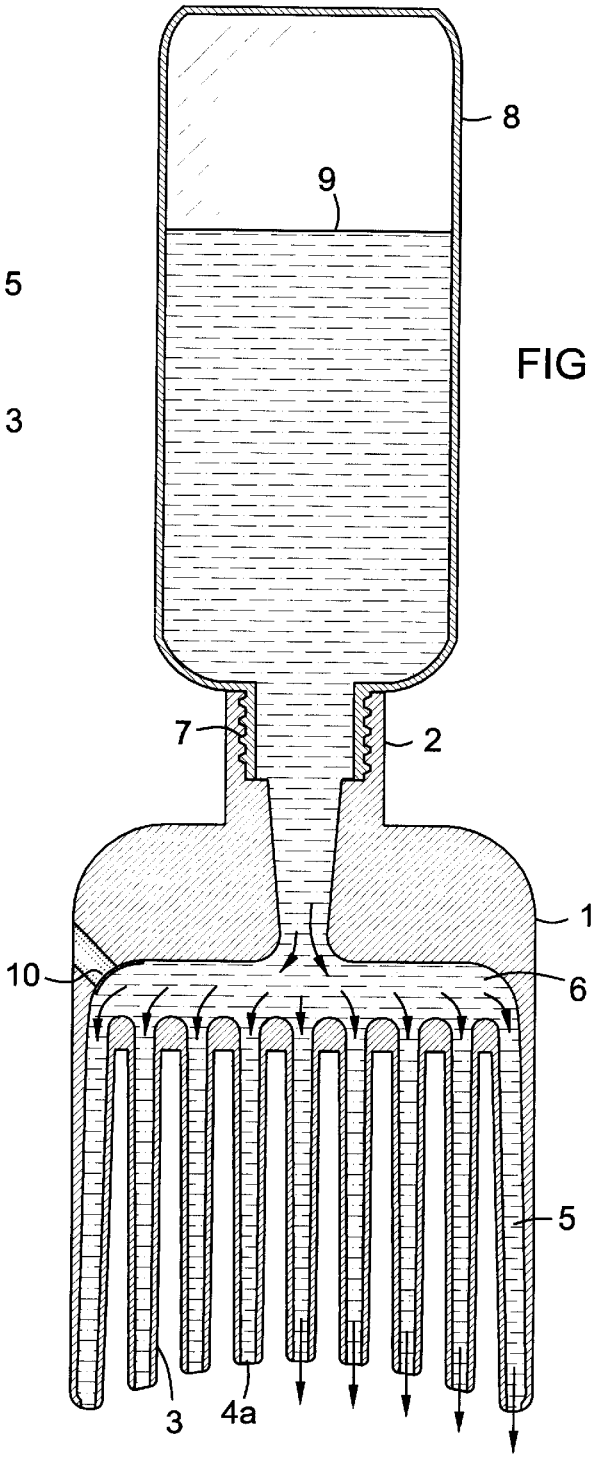
FIG 9

HAIR COLORANT APPLICATOR COMB AND METHOD

CROSS-REFERENCE TO RELATED APPLICATIONS

This application claims the benefit of U.S. Provisional application No. 60/143,855, filed Jul. 15, 1999.

BACKGROUND OF THE INVENTION

1. Field of the Invention

This invention relates to hair colorant applicators.

2. Description of Prior Art

Coloring of human hair is an old art. A common problem when using long-lasting hair dyes is the showing of non-colored hair emerging from the scalp as the hair grows. To avoid this revelation of non-colored hair, the choice is either to re-color all of the hair or to apply hair coloring to the scalp in a way that effects only the emerging new growth.

Re-coloring of hair is difficult, involving stripping of color, then application of the color of choice, and finally a rinse and set. This process often causes dry brittle hair, so it cannot be used very frequently. Often a better option is to apply colorant only to the scalp and hair root or base to match the previously colored hair.

The process currently used to color hair roots only is difficult. It involves partitioning or sectioning of the hair, then using a single-stream applicator to apply colorant to the exposed scalp and hair roots. This approach covers an area of approximately one-half to one square inch at a time, and must be repeated until the entire scalp and roots have been colored. This is time-consuming and arduous, and is also costly if done in a beauty parlor.

SUMMARY OF THE INVENTION

The objective of the present invention is provision of an applicator that applies colorant only to the base of a user's hair, easily and quickly, in order to color newly emerged hair without deepening the color of the rest of the hair.

This is achieved in a hair colorant applicator in the form of a hollow comb 1 with a threaded receiver top 2 that accepts standard plastic bottles 8 of hair colorant in the inverted position. The teeth of the comb are in the form of tubes. A hollow channel 5 in each tube 3 of the comb terminates in an orifice 4*a* at the tip of each tube. Hair colorant 9 flows from the bottle, through the body of the comb 6, through the channels in the tubes, and exits the tips of the tubes. This applies the colorant at the base of hair near the scalp to maintain uniform hair coloring as the hair grows. Newly emerged uncolored hair near the scalp can be colored without deepening the color of the rest of the hair. The user squeezes the bottle of colorant as it is applied to control the flow rate.

BRIEF DESCRIPTION OF THE DRAWINGS

FIG. 1 is a front view of a hair colorant applicator comb per this invention.

FIG. 2 is a side view of FIG. 1.

FIG. 3 is a bottom view of FIG. 1.

FIG. 4 is a front sectional view of FIG. 1 along line 4—4 of FIG. 2.

FIG. 5 is a side sectional view of FIG. 1 along line 5—5 of FIG. 1.

FIG. 6 is a view as in FIG. 4, with embodiment 4*b* of the orifices.

FIG. 7 is a view as in FIG. 5, with embodiment 4*c* of the orifices.

FIG. 8 is an enlarged view of some tube tips with orifice embodiment 4*b*.

FIG. 9 is a view as in FIG. 4, with a colorant bottle attached.

REFERENCE NUMBERS

1. Body of applicator comb
2. Receiver top
3. Tube or hollow tooth of the comb
4*a*. Orfice, downward-facing embodiment
4*b*. Orifice, sideward-facing embodiment
4*c*. Orifice, backward-facing embodiment
5. Channel in tube
6. Hollow area or manifold of body
7. Internal threads in receiver top
8. Bottle of hair colorant
9. Hair colorant fluid
10. Optional one-way air inlet valve

DETAILED DESCRIPTION

This hair colorant applicator comb has an internally threaded top 2 that is sized to accommodate standard squeeze-type hair color bottles. This top leads to a manifold 6, from which depend comb teeth in the form of dispensing tubes 3. A fluid communication path exists from the top 2 through the tips of the tubes. The tips of the tubes have orifices 4*a*, 4*b*, or 4*c* that dispense colorant against or near the scalp. Hair colorant flows from the colorant bottle, through the receiver top 2, then through the manifold 6, then through channels 5 in the tubes 3, then through the orifices 4*a*, 4*b*, or 4*c* and onto the scalp.

The orifices may open downward at the ends of the tubes as shown in FIGS. 3–5. This version of the orifices is labeled 4*a*. Another form of orifices 4*b* is shown in FIGS. 6 and 8, in which two opposed holes in the end of each tube face generally along the line of the tube tips. This avoids blocking the orifice by contact with the scalp. A third form of orifice 4*c* is shown in FIG. 7, in which the opening faces rearward. This also avoids blocking the orifice by contact with the scalp. Orifice versions 4*b* and 4*c* are just two examples of orifices that open on a side of the tube near its tip. They can also open forward or to any other direction around the tip of the tube.

In practice, the user grasps the applicator comb by the dispensing bottle and manifold. The user places the tips of the tubes against the scalp at the front of the head. The applicator comb is drawn through the hair to the back of the head while maintaining contact of the tube tips with the scalp, and squeezing the dispensing bottle to force colorant onto the scalp. Upon reaching the back of the head, the applicator comb is withdrawn from the head and placed on the scalp at the front of the head beside the previous pass. This process is repeated until the entire scalp has been covered.

An optional one-way inlet valve 10 may be provided as shown in FIG. 9 to allow air to recharge the bottle 8 for the next squeeze. Otherwise, air must flow backward from the orifices for this purpose. The inlet valve can be located anywhere on the body, providing one-way air communication from the exterior to the interior. If a custom bottle is provided, the one-way inlet valve can be provided on the bottle instead of the comb.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

I claim:

1. A hair colorant applicator comb comprising:

a hollow body having a top, bottom, interior, and exterior;

an internally threaded receiver on the top of the body;

a plurality of hollow tubes depending from the bottom of the body, each tube having a tip;

at least one orifice in each of the tips of at least some of the tubes;

a fluid communication channel from the receiver, through the hollow body, through the hollow tubes, to the at least one orifice; and, a simple, passive, one-way air inlet valve between the interior and exterior of the body, that admits air into the interior of the body, and that opens automatically when a partial vacuum exists in the communication channel;

whereby an open bottle of hair colorant can be screwed into the receiver, and the comb can be passed over a user's scalp while hair colorant flows from the at least one orifice to color only the base of the user's hair.

2. A method of applying hair colorant to the base of a user's hair, comprising the steps of:

providing a hollow comb with a threaded receiver top for accepting a hair colorant bottle, the comb having hollow tubes with open tips, and having a fluid communication channel from the receiver top through the tips of the tubes;

providing a simple, passive, one-way air inlet valve between the interior and exterior of the body, that admits air into the interior of the body, and that opens automatically when a partial vacuum exists in the communication channel;

providing an elastic, compressible bottle of hair colorant with an open threaded top and an interior volume;

screwing the top of the bottle into the receiver top of the comb;

placing the tips of the tubes against a user's scalp and drawing the comb through the user's hair and along the scalp while manually squeezing the bottle; and, releasing the hand pressure on the bottle temporarily, causing a partial vacuum in the communication channel that opens the air inlet valve, allowing the bottle to elastically recover at least part of its volume for another squeeze;

whereby hair colorant flows from the bottle through the comb to the tips of the tubes, onto the user's scalp, and around the roots of the user's hair.

* * * * *